US011365901B2

(12) United States Patent
Liao

(10) Patent No.: US 11,365,901 B2
(45) Date of Patent: Jun. 21, 2022

(54) DIRECT-HEATING TYPE HEATER

(71) Applicant: SHANGHAI KOHLER ELECTRONICS, LTD., Shanghai (CN)

(72) Inventor: Desheng Liao, Shanghai (CN)

(73) Assignee: SHANGHAI KOHLER ELECTRONICS LTD., Shanghai (CN)

( * ) Notice: Subject to any disclaimer, the term of this patent is extended or adjusted under 35 U.S.C. 154(b) by 656 days.

(21) Appl. No.: 16/230,065

(22) Filed: Dec. 21, 2018

(65) Prior Publication Data

US 2019/0195530 A1 Jun. 27, 2019

(30) Foreign Application Priority Data

Dec. 25, 2017 (CN) ..... 201711421931.9

(51) Int. Cl.
*F24H 1/10* (2022.01)
*F24H 9/00* (2022.01)

(52) U.S. Cl.
CPC ..... *F24H 1/103* (2013.01); *F24H 9/0021* (2013.01)

(58) Field of Classification Search
None
See application file for complete search history.

(56) References Cited

U.S. PATENT DOCUMENTS 1,188,952 A * 6/1916 Laird ..... F24H 1/102 392/493
1,671,677 A * 5/1928 Keeton ..... F24H 1/142 392/489
1,688,796 A * 10/1928 Baker ..... F24H 1/102 392/398
3,643,733 A * 2/1972 Hall ..... F28F 9/0219 165/81
4,286,140 A * 8/1981 Dewulf ..... F24H 9/2014 165/156
4,465,922 A * 8/1984 Kolibas ..... F24H 1/121 165/156
4,480,172 A * 10/1984 Ciciliot ..... H05B 3/42 392/396
4,563,571 A * 1/1986 Koga ..... H05B 3/42 219/543
4,975,559 A * 12/1990 Frisch ..... A47J 31/542 392/449
5,441,710 A * 8/1995 Marois ..... B01D 45/16 392/485

(Continued)

*Primary Examiner* — Thor S Campbell
(74) *Attorney, Agent, or Firm* — Foley & Lardner LLP

(57) ABSTRACT

The present application discloses a direct-heating type heater that includes a direct-heating type heater shell, a heating device arranged inside the direct-heating type heater shell, and a direct-heating type heater component, wherein at least one segment of the heating device is installed with a metal elastic device, and the inner wall of the direct-heating type heater shell corresponding to the heating device with no metal elastic device installed is partially or wholly provided with a helical groove structure. Such a heater solves the problem of the prior art that the heat transfer efficiency is low due to the low heat dissipation capability of ceramics, and also solves the problem that water temperature is not even as water passes through the heater quickly and the water cannot be mixed fully and homogeneously.

20 Claims, 1 Drawing Sheet

(56) References Cited

U.S. PATENT DOCUMENTS

| | | | | |
|---|---|---|---|---|
| 7,458,807 | B2 * | 12/2008 | Alfoldi | F28D 7/026 431/11 |
| 7,756,404 | B2 * | 7/2010 | Schubert | F28D 7/026 392/478 |
| 8,180,207 | B2 * | 5/2012 | Shirai | F24H 9/2028 392/491 |
| 9,014,548 | B2 * | 4/2015 | Jang | B60H 1/2221 392/465 |
| 9,803,886 | B2 * | 10/2017 | Chang | F24H 1/121 |
| 10,051,991 | B2 * | 8/2018 | Blanc | B23P 15/00 |
| 2012/0103968 | A1 * | 5/2012 | Lu | F24H 1/225 219/429 |
| 2014/0050466 | A1 * | 2/2014 | Giffels | H05B 3/22 392/488 |

* cited by examiner

DIRECT-HEATING TYPE HEATER

CROSS-REFERENCE TO RELATED PATENT APPLICATIONS

This present application claims the benefit of and priority to CN Patent Application No. 201711421931.9, which was filed on Dec. 25, 2017, and is incorporated by reference herein in its entirety.

BACKGROUND

The present application relates generally to the field of machinery, and more specifically, relates to a direct-heating type heater.

In the structures of existing direct-heating type heaters, a water flow rapidly and directly passes through a cavity formed by ceramic heating pipes and a heater shell. The ceramic pipes and the inner wall of the shell are all smooth surfaces with no other auxiliary structures. Therefore, the water flow rapidly and directly passes through the cavity, and the thermal energy is directly transferred by the ceramic heating pipes to the flowing water. Since ceramics have a low heat dissipation capability, however, the heat transfer efficiency is low.

Since the water passes through the heater quickly, the water cannot be mixed fully and homogeneously, and as a result, the water temperature is not even. In existing heater products, a small water mixing tank device is typically provided on the rear water path of a direct-heating type heater so as to solve the problem of uneven water temperature. However, such a method increases the overall volume of the heaters and increases the cost. Additionally, by providing a small water mixing tank on the rear water path, the water temperature increasing rate is relatively low.

SUMMARY

An object of the present invention is to overcome the drawbacks of the prior art by providing a direct-heating type heater that solves the problem that the heat transfer efficiency is low due to the low heat dissipation capability of ceramics, and also solves the problem that water temperature is not even as water passes through the heater quickly and the water cannot be mixed fully and homogeneously.

A technical solution of present invention provides a direct-heating type heater that includes a direct-heating type heater shell, a heating device arranged inside the direct-heating type heater shell, and direct-heating type heater components, wherein at least one segment of the heating device is installed with a metal elastic device, and the inner wall of the direct-heating type heater shell, which corresponds to the heating device with no metal elastic device installed, is partially or wholly provided with a helical groove structure.

Another technical solution provides a direct-heating type heater that includes a shell having an inner wall with a helical groove structure in a portion thereof; a water inlet disposed at a side of the shell; a heating device disposed within the shell and including a pipe extending between a first end and a second end, the pipe defining an internal passage with the first end fluidly connected to the water inlet and the second end opening to a fluid passage located between the shell and the pipe; and a metal elastic device provided around a portion of the heating device between the inner wall of the pipe and an outer surface of the shell in a radial direction and between the second end and the helical groove structure in a longitudinal direction.

Moreover, a front segment of the heating device is installed with the metal elastic device, and the inner wall of the direct-heating type heater shell, which corresponds to the heating device with no metal elastic device installed, is partially or wholly provided with the helical groove structure.

Moreover, the inner wall of the direct-heating type heater shell, which corresponds to the heating device with no metal elastic device installed, is wholly provided with the helical groove structure, and the length of the metal elastic device after being installed on the heating device is three-fourths of the length of the heating device.

Moreover, a rear segment of the heating device is installed with the metal elastic device.

Moreover, two segments of the heating device are installed with the metal elastic device, and the inner wall of the direct-heating type heater shell, which corresponds to the segment between the two segments of the heating device, is provided with the helical groove structure. Alternatively, one segment of the heating device can be installed with the metal elastic device, and the inner wall of the direct-heating type heater shell, which corresponds to two sides of the installed metal elastic device, is provided with the helical groove structure, respectively.

Moreover, the heating device can include a ceramic heating pipe.

Moreover, the metal elastic device can include a metal wire and/or a metal spring.

Moreover, the metal wire and/or the metal spring can be fastened to the heating device.

Moreover, the direct-heating type heater shell can be integrally formed with the helical groove structure.

The adoption of the above technical solutions achieves advantageous effects, such as, where at least one segment of the heating device is installed with a metal elastic device, and the inner wall of the direct-heating type heater shell corresponding to the heating device with no metal elastic device installed is partially or wholly provided with a helical groove structure. This arrangement solves the problem that the heat transfer efficiency is low due to the low heat dissipation capability of ceramics, and also solves the problem that water temperature is not even as water passes through the heater quickly and the water cannot be mixed fully and homogeneously. The present embodiment makes the water heating rate of the direct-heating type heater faster and the water temperature more even, while simplifying the structure of direct-heating type heaters of the prior art, which does not need to provide a small water mixing tank device on the rear water path of a direct-heating type heater so as to make the water temperature even, thereby reducing the overall volume of the direct-heating type heater and reducing the cost.

BRIEF DESCRIPTION OF THE DRAWINGS

By referring to the accompanying drawing, the disclosure of the present invention will become easier to understand. It should be understood that the accompanying drawing is used only for the purpose of description, rather than intended to limit the protection scope of the present invention.

DETAILED DESCRIPTION

Figure 1:
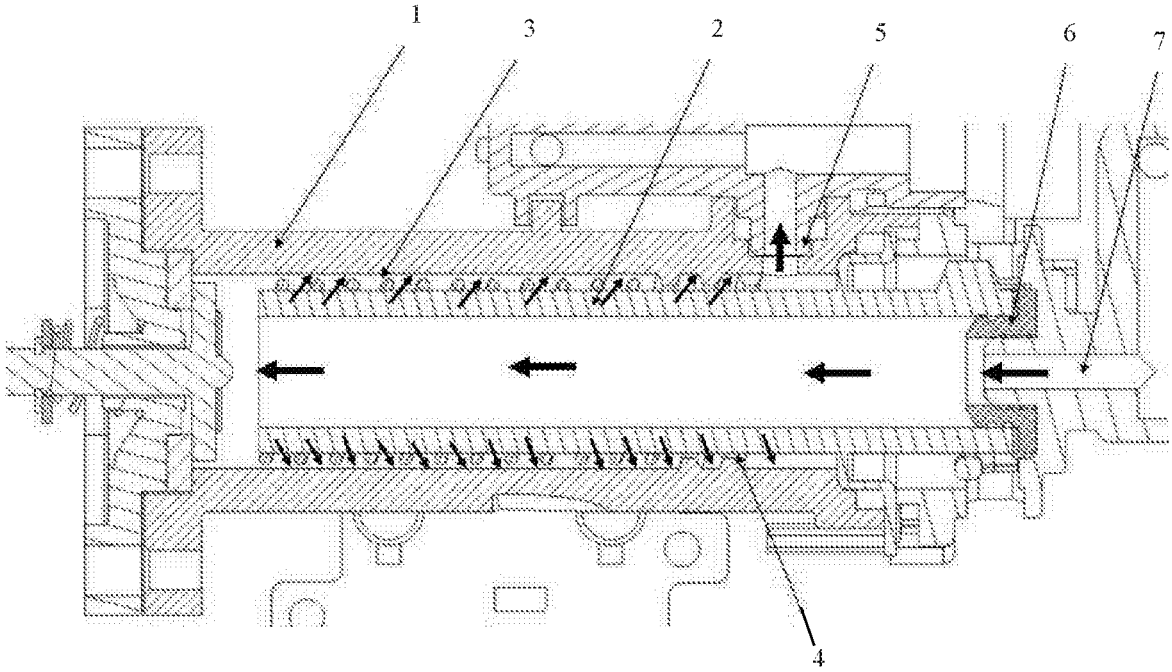
FIG. 1 is a cross-sectional view of a direct-heating type heater of an embodiment of the present invention.

The specific implementation manner of the present invention will be further described below with reference to the accompanying drawing.

FIG. 1 shows an embodiment of a direct-heating type heater that includes a direct-heating type heater shell 1, a heating device 2 arranged inside the direct-heating type heater shell 1, and direct-heating type heater components. At least one segment (e.g., portion, part, etc.) of the heating device 2 is installed with a metal elastic device 3, and the inner wall of the direct-heating type heater shell 1, which corresponds to the heating device 2 with no metal elastic device 3 installed, is either partially or wholly provided with a helical groove structure 4.

When water flow rapidly passes through a cavity formed by ceramic heating pipes and a heater shell, the thermal energy is directly transferred by the ceramic heating pipes to the flowing water. Since ceramics have a relatively low heat dissipation capability, the heat transfer efficiency of such systems is low. Therefore, as shown in FIG. 1, at least one segment of the heating device 2 is installed with the metal elastic device 3, and the metal elastic device 3 has high heat transfer efficiency, such that the flowing water can pass the metal elastic device 3 by flowing around it, thereby raising the water temperature.

By way of example, the metal elastic device 3 can be a metal spring. Since a regular heating device 2 uses a ceramic heating pipe, the water flow flows around the ceramic heating pipe when the metal spring is wound around the ceramic heating pipe, so that water can conduct heat exchange more thoroughly with the ceramic heating pipe, and on the other hand, the metal material has better heat transfer capability than the ceramic material and can be used as a medium for transferring heat to water by the ceramic material, which further improves the heat transfer efficiency of the ceramic heating pipe.

Traditionally, water temperature is not even as water passes through the heater quickly and, therefore, the water cannot be mixed fully and homogeneously. Therefore, as shown in FIG. 1, the inner wall of the direct-heating type heater shell 1, which corresponds to the heating device 2 with no metal elastic device 3 installed, is partially or wholly provided with a helical groove structure 4 to cooperate with the metal elastic device 3. After the water flow enters the direct-heating type heater shell 1 from the water inlet 7, the water flow close to the heating device 2 has a different temperature from that of the water flow close to the direct-heating type heater shell 1. When the water flows to the helical groove structure 4, the helical groove structure 4 forces the water flow to enter into the helical groove, so that the water flow can be mixed more homogeneously, thereby, the water temperature becomes even, and the homogeneously mixed water flow exits from the shell water outlet 5.

It is noted that the directions indicated by the arrows in FIG. 1 show the water flowing directions. The direct-heating type heater components can include, for example, a seal 6, which is shown located between the water inlet 7 and the heating device 2, the water inlet 7, and/or other elements shown or described.

According to an exemplary embodiment, at least one segment of the heating device 2 is installed with the metal elastic device 3, and the inner wall of the direct-heating type heater shell 1 corresponding to the heating device 2 with no metal elastic device 3 installed is partially or wholly provided with the helical groove structure 4. Such an embodiment solves the problem of traditional devices that the heat transfer efficiency is low due to the low heat dissipation capability of ceramics, and also solves the problem that water temperature is not even as water passes through the heater quickly and the water cannot be mixed fully and homogeneously. The present embodiment makes the water heating rate of the direct-heating type heater faster and water temperature more even, and also simplifies the structure of direct-heating type heaters of the prior art, which does not need to provide a small water mixing tank device on the rear water path of a direct-heating type heater so as to make the water temperature even, thereby reducing the overall volume of the direct-heating type heater and also reducing the cost.

In an exemplary embodiment, a front segment of the heating device 2 is installed with the metal elastic device 3, and the inner wall of the direct-heating type heater shell 1 corresponding to the heating device 2 with no metal elastic device 3 installed is partially or wholly provided with the helical groove structure 4. The front segment of the heating device 2 is installed with the metal elastic device 3, so that water is first heated rapidly, and then the water is mixed homogeneously, and a user can directly enjoy water with a good water temperature through mixing.

In an exemplary embodiment, the inner wall of the direct-heating type heater shell 1 corresponding to the heating device 2 with no metal elastic device 3 installed is wholly provided with the helical groove structure 4, and a length of the metal elastic device 3 after being installed on the heating device 2 is approximately three-fourths of a length of the heating device 2.

By providing the helical groove structure 4 on the inner wall of the direct-heating type heater shell 1 corresponding to the heating device 2 with no metal elastic device 3 installed, the helical groove structure 4 can have more space for mixing water temperature. Although a typical helical groove structure 4 has from 3 to 5 rounds, the structure can have fewer or additional rounds. The helical groove structure 4 has a pitch. According to a non-limiting example, the pitch is approximately 3 mm.

In an exemplary embodiment, a rear segment of the heating device 2 is installed with the metal elastic device 3.

Alternatively, water can be mixed first so that its temperature is even, and then the water is heated, which can also achieve the goal of rapid heating and making the water temperature even, compared to traditional systems.

In an exemplary embodiment, two segments of the heating device 2 are installed with the metal elastic device 3, and the inner wall of the direct-heating type heater shell 1 corresponding to the segment between the two segments of the heating device 2 is provided with the helical groove structure 4. Alternatively, one segment of the heating device 2 can be installed with the metal elastic device 3, and the inner wall of the direct-heating type heater shell 1 corresponding to two sides of the installed metal elastic device 3 can be provided with the helical groove structure 4, respectively.

Two metal elastic devices 3 can be installed on two segments of the heating device 2. After a water flow enters the system (e.g., via a water inlet), the water is first heated rapidly, and then the cold water and hot water are mixed to make the water temperature even, and then the water is heated again. Alternatively, a metal elastic device 3 can be installed on one segment of the heating device 2, and the inner wall of the direct-heating type heater shell 1 corresponding to two sides of the installed metal elastic device 3 is provided with the helical groove structure 4, respectively. After a water flow enters the system, the water is mixed first, then heated, and then mixed again, so as to achieve the goal of rapid heating and making the water temperature even.

In an exemplary embodiment, the heating device 2 includes a ceramic heating pipe, which is selected because the ceramic heating pipe is resistant to high temperature and corrosion, has good thermochemical stability, long service life, high insulation strength, and no pollution. Compared with other electric heating elements, the energy savings of such a device can be around thirty percent (30%).

In an exemplary embodiment, the metal elastic device 3 includes a metal wire and/or a metal spring. By winding the metal wire around the heating device 2 and/or fastening the metal spring to the heating device 2, the thermal conductivity of the heating device 2 is strengthened (e.g., increased).

In an exemplary embodiment, the metal wire and/or the metal spring is fastened to the heating device 2.

In an exemplary embodiment, the direct-heating type heater shell 1 is integrally formed with the helical groove structure 4. That is, the helical groove structure 4 is a helical groove on the inner wall of the direct-heating type heater shell 1. The adoption of the helical groove structure enables water having different water temperatures to rotate therein, so that the water flow is mixed to make the water temperature even. By the manner in which the direct-heating type heater shell 1 is integrally formed with the helical groove structure 4, the direct-heating type heater shell 1 and the helical groove structure 4 can be processed simultaneously to save the cost, reduce installation steps, and also makes the connection between the two elements seamless. When observed from the external surface of the direct-heating type heater shell 1, the helical groove structure 4 can be configured to protrude externally.

It should be understood that, according to the technical solution of the present invention, a person skilled in the art can use a plurality of mutually exchangeable structural manners and implementation manners without changing the substantial spirit of the present invention. Therefore, the following specific implementation manner and accompanying drawing both are merely exemplary description of the technical solution of the present invention, and shall not be regarded as all of the present invention or as restrictions or limitations to the technical solution of the present invention.

Directional terms mentioned or potentially mentioned in the specification, including up, down, left, right, front, back, front side, back side, top side, and bottom, are defined relative to the construction shown in the accompanying drawing, and they are relative concepts and therefore may change correspondingly according to locations and different use conditions thereof. Therefore, these or other directional terms shall not be construed as restrictive terms.

Only the principle and preferred embodiments of the present invention are described above. It should be noted that, to a person skilled in the art, a number of other variations can be further made based on the principle of the present invention and shall be encompassed by the protection scope of the present invention.

What is claimed is:

1. A direct-heating type heater, comprising:

a direct-heating type heater shell;

a heating device arranged inside of the direct-heating type heater shell and comprising an internal passage extending through the heating device, the heating device configured to transfer heat to fluid flowing through the internal passage; and a direct-heating type heater component, wherein at least one segment of the heating device is installed with a metal elastic device, and a portion of an inner wall of the direct-heating type heater shell corresponding to the heating device with no metal elastic device installed is partially or wholly provided with a helical groove structure, the at least one segment with the metal elastic device providing a higher rate of heat transfer from the heating device to the fluid than the portion with the helical groove structure, wherein the direct-heating type heater shell and the heating device cooperate to form a helical flow path around the heating device and the internal passage and are configured to cause the fluid to reverse direction upon exiting the internal passage and enter the helical flow path after reversing direction.

2. The direct-heating type heater of claim 1, wherein a front segment of the heating device is installed with the metal elastic device, and the portion of the inner wall of the direct-heating type heater shell corresponding to the heating device with no metal elastic device installed is partially provided with the helical groove structure.

3. The direct-heating type heater of claim 1, wherein a front segment of the heating device is installed with the metal elastic device, and the portion of the inner wall of the direct-heating type heater shell corresponding to the heating device with no metal elastic device installed is wholly provided with the helical groove structure.

4. The direct-heating type heater of claim 3, wherein a length of the metal elastic device after being installed on the heating device is approximately three-fourths of a length of the heating device.

5. The direct-heating type heater of claim 1, wherein a rear segment of the heating device is installed with the metal elastic device.

6. The direct-heating type heater of claim 1, wherein two end segments of the heating device are installed with the metal elastic device, and the portion of the inner wall of the direct-heating type heater shell corresponding to the heating device with no metal elastic device installed is an intermediate segment located between the two end segments.

7. The direct-heating type heater of claim 1, wherein one segment of the heating device is installed with the metal elastic device, and the inner wall of the direct-heating type heater shell corresponding to two sides of the installed metal elastic device is provided with the helical groove structure, respectively.

8. The direct-heating type heater of claim 1, wherein the heating device comprises a ceramic heating pipe.

9. The direct-heating type heater of claim 1, wherein the metal elastic device comprises a metal wire or a metal spring.

10. The direct-heating type heater of claim 9, wherein the metal wire or the metal spring is fastened to the heating device.

11. The direct-heating type heater of claim 10, wherein the direct-heating type heater shell is integrally formed with the helical groove structure.

12. The direct-heating type heater of claim 1, wherein the direct-heating type heater shell is integrally formed with the helical groove structure.

13. The direct-heating type heater of claim 1, wherein the direct-heating type heater component comprises a seal located between a water inlet and an end of the heating device.

14. A direct-heating type heater, comprising:

a shell having an inner wall with a helical groove structure in a portion thereof;

a water inlet disposed at a side of the shell;

a heating device disposed within the shell and including a pipe extending between a first end and a second end, the pipe defining an internal passage with the first end fluidly connected to the water inlet and the second end opening to a fluid passage located between the shell and an outer surface of the pipe; and a metal elastic device provided around a portion of the heating device between the inner wall of the shell and the outer surface of the pipe in a radial direction and between the second end and the helical groove structure in a longitudinal direction, wherein fluid absorbs heat from an inner surface of the pipe while flowing through the internal passage, reverses direction after exiting the second end of the pipe, and enters the fluid passage located between the shell and the outer surface of the pipe after reversing direction, and wherein the portion of the heating device provided with the metal elastic device provides a higher rate of heat transfer from the heating device to the fluid than the portion with the helical groove structure.

15. The direct-heating type heater of claim 14, further comprising a seal located between the water inlet and the first end of the pipe of the heating device.

16. The direct-heating type heater of claim 14, further comprising an outlet in fluid communication with the fluid passage, wherein the outlet is located downstream of the helical groove structure.

17. The direct-heating type heater of claim 14, wherein the pipe is a ceramic heating pipe.

18. The direct-heating type heater of claim 14, wherein the metal elastic device is configured as a helical spring or a helical wire.

19. The direct-heating type heater of claim 18, wherein the helical spring or the helical wire extends from the second end of the pipe to the helical groove structure.

20. The direct-heating type heater of claim 19, wherein a length of the helical spring or the helical wire in the longitudinal direction is less than or equal to three-fourths of a length of the heating device in the longitudinal direction.

* * * * *